US005330276A

United States Patent [19]

Tanida

[11] Patent Number: 5,330,276

[45] Date of Patent: Jul. 19, 1994

[54] DIVISIONAL STEP DOT PRINTING DEVICE

[75] Inventor: Toshifumi Tanida, Oume, Japan

[73] Assignee: Fujitsu Limited, Kawaskai, Japan

[21] Appl. No.: 89,614

[22] Filed: Jul. 12, 1993

Related U.S. Application Data

[63] Continuation of Ser. No. 833,617, Feb. 13, 1992, abandoned, which is a continuation of Ser. No. 489,590, Mar. 7, 1990, abandoned.

[30] Foreign Application Priority Data

Mar. 10, 1989 [JP] Japan ..... 1-59442

[51] Int. Cl.[5] ..... B41J 2/30

[52] U.S. Cl. ..... 400/124; 395/108

[58] Field of Search ..... 400/121, 124; 395/108

[56] References Cited

U.S. PATENT DOCUMENTS 4,521,123 6/1985 Boehmer ..... 400/121

FOREIGN PATENT DOCUMENTS 186508 7/1986 European Pat. Off. ..... 400/121

*Primary Examiner*—David A. Wiecking

*Attorney, Agent, or Firm*—Nikaido, Marmelstein, Murray & Oram

[57] ABSTRACT

A divisional step dot printing device for a wire dot printer in which a plurality of dot pins of the dot printing head is divided into a plurality of groups of a sequence of dot pins and is driven in a sequence of divisional dot printing steps. Each of the divisional dot printing steps is carried out by a combination of groups of dot pins which substantially cover the center line of the platen.

7 Claims, 11 Drawing Sheets

| Fig.11A | Fig.11B |
|---|---|

DIVISIONAL STEP DOT PRINTING DEVICE

This application is a continuation of application Ser. No. 07/833,617, filed Feb. 13, 1992, which is a continuation of application Ser. No. 07/489,590, filed Mar. 7, 1990, both now abandoned.

BACKGROUND OF THE INVENTION

1. Field of the Invention

The present invention relates to a divisional step dot printing device for a wire dot printer. The device according to the present invention can be used for a wire dot type serial printer used, for example, in an electronic computer system.

2. Description of the Related Arts

In a prior art method of divisional step dot printing with a wire dot printer, all of the dot pins are divided into a plurality of groups each consisting of a plurality of successive dot pins, and a first group of dot pins is driven in a first divisional step during a first travel of a carriage over the length of a platen, the next group of dot pins is driven in the next divisional step during the next travel of the carriage over the length of the platen, and the succeeding group of dot pins is driven in the next divisional step during the next travel of the carriage over the length of the platen.

In this method, one row of printing is constituted by a plurality of parts thereof, and the printing of this plurality of parts is carried out sequentially to print one row.

In this method, however, a problem arises in that the paper to be printed and placed on the platen is deformed in different ways during the sequence of the divisional printing steps, leading to an undesirable shifting of the paper, and accordingly, the colors printed by the sequence of divisional printing steps are overlapped or separated from each other.

In another prior art method of divisional step dot printing with a wire dot printer, all of the dot pins are divided into a plurality of groups each consisting of a plurality of dot pins, at intervals of two dot pin positions, and a first group is driven in the first divisional step during the first travel of a carriage over the length of a platen, the next group is driven in the next divisional step during the next travel of a carriage over the length of a platen, and the succeeding group is driven in the next divisional step during the next travel of the carriage over the length of the platen.

In this method, one row of printing is constituted by a plurality of row constituents, and the printing of this plurality of row constituents are carried out sequentially to accomplish the printing of one row.

In this method, however, a problem arises in that the space between adjacent and simultaneously driven dot pins is relatively large, and therefore, the impact of a dot pin on the paper on the platen is made only by a single dot pin, without considering the accumulated effect of the simultaneous impact of a plurality of adjacent dot pins, and accordingly, the density of the colors printed by the sequence of divisional printing steps is usually low.

SUMMARY OF THE INVENTION

An object of the present invention is to provide an improved divisional step dot printing device for a wire dot printer in which the overlapping and separation of the printed colors are prevented by preventing an undesirable shift of the paper during the divisional dot printing steps, and a satisfactory density of the colors printed by the divisional dot printing steps is maintained by the effect of the simultaneous impact of a plurality of adjacent dot pins.

Therefore, in accordance with the present invention, there is provided a divisional step dot printing device for a dot printer including: a dot printing head having a plurality of dot pins; a print medium on which printing by the dot pins is carried out; and a platen arranged opposite to the dot printing head and on which the print medium for dot printing is placed; the plurality of dot pins of the dot printing head being divided into a plurality of groups of a sequence of dot pins and being driven in a sequence for divisional step dot printing; each of the divisional step dot printing operations being carried out by a combination of groups of dot pins which substantially cover the center line of the platen.

DESCRIPTION OF THE PREFERRED EMBODIMENTS

Before describing the preferred embodiments in detail, the structure of a dot printer to which the device according to the present invention is to be applied and a prior art method of divisional step dot printing will be described with reference to FIGS. 1 to 7.

Figure 1:
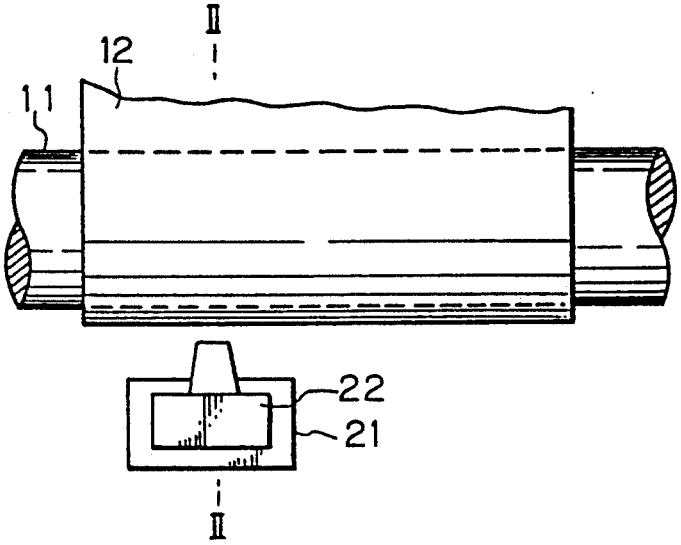
Fig. 1 PRIOR ART
FIG. 1 is a plan view of the structure of a dot printer to which the device according to the present invention is to be applied.
Figure 2:
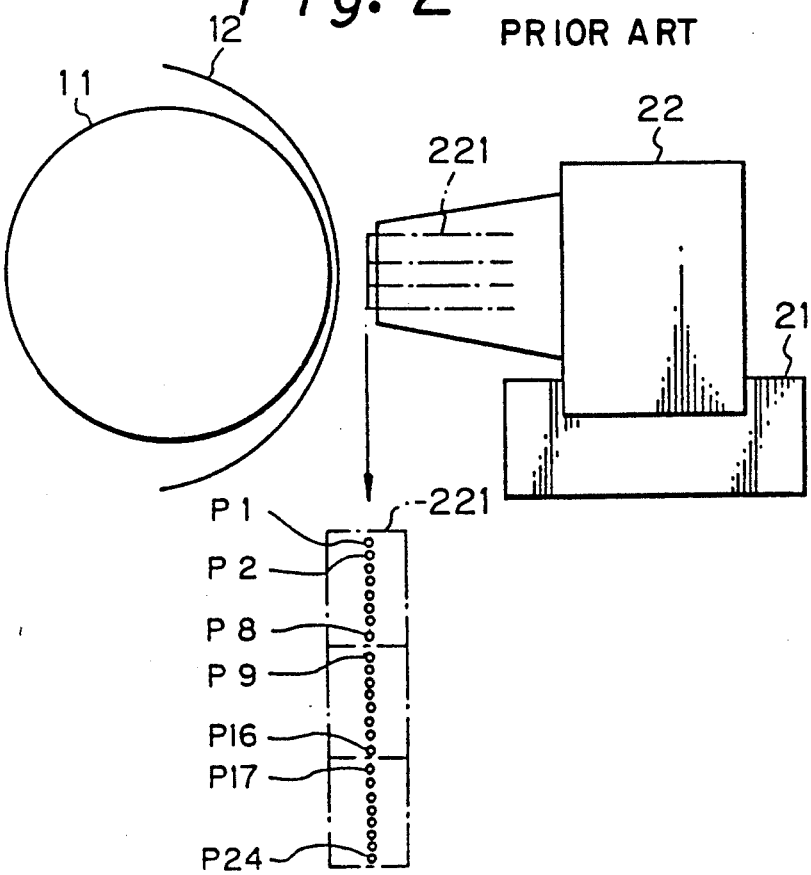
Fig. 2 PRIOR ART
FIG. 2 is a cross-sectional view taken along the line II—II of FIG. 1.

As shown in FIGS. 1 and 2, a dot printer to which the device according to the present invention is to be applied is constituted by a platen 11, a paper 12 to be printed, and a carriage 21 on which a printing head 22 is mounted. In the printing head 22, a one line sequence of wire dot pins P1, P2, . . . P24 is arranged as shown in FIG. 2. Note, it is possible to arrange a two line sequence of wire dot pins.

In a printing operation, while the carriage 21 is moved over the length of the platen 11, the selected ones of the dot pins P1, P2, . . . P24 are driven to strike the paper 12 on the platen 11, to carry out a printing operation on the paper 12. One row of printing on the paper 12 by the dot pins P1, P2, . . . P24 is carried out during one travel of the carriage 21 over the length of the platen 11 or during a plurality of travels of the carriage 21 over the length of the platen 11. The latter type printing is called a divisional step dot printing.

Figure 3:
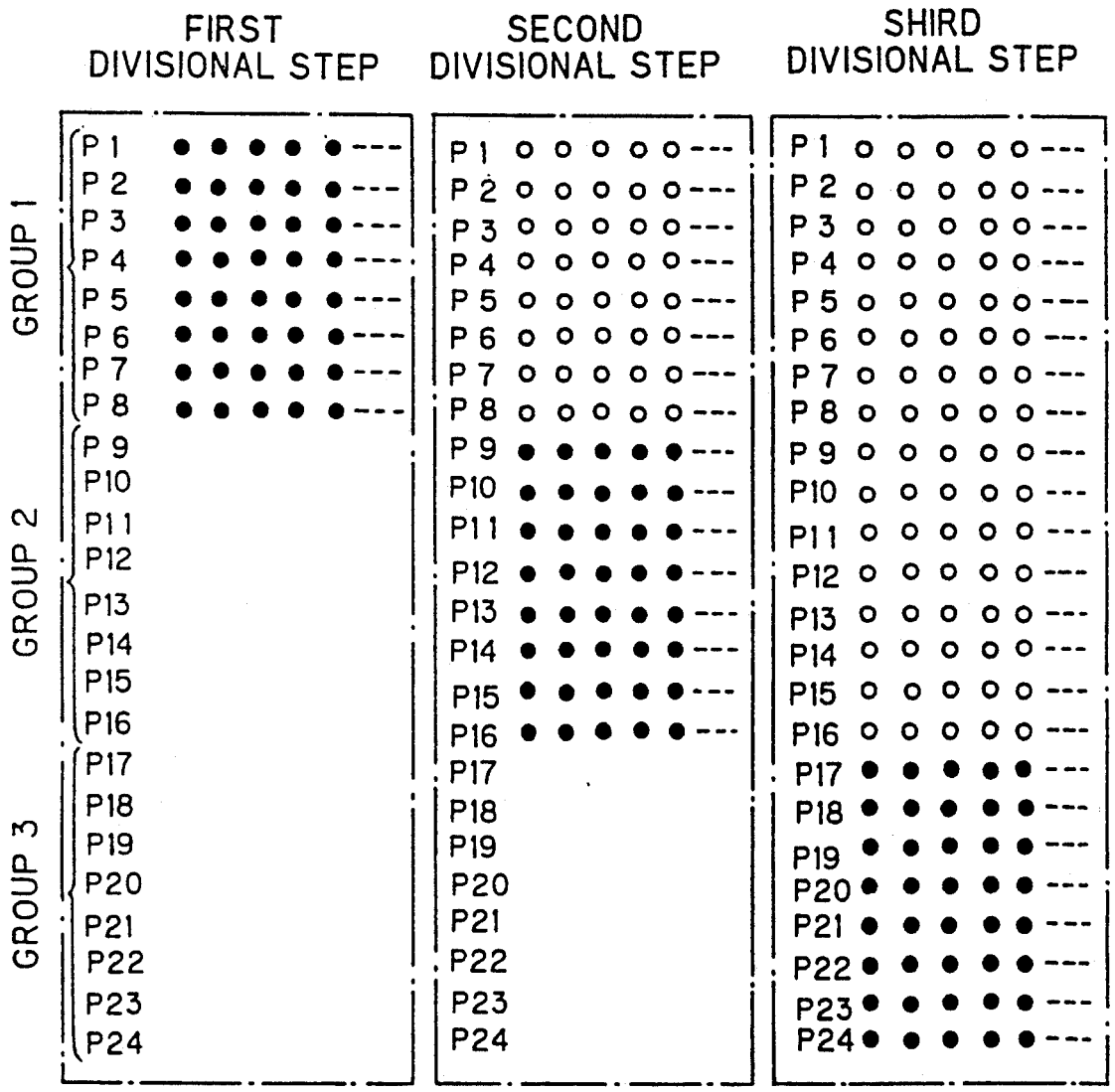
Fig. 3 PRIOR ART
FIGS. 3 and 4 illustrate a prior art method of divisional step dot printing.
Figure 4:
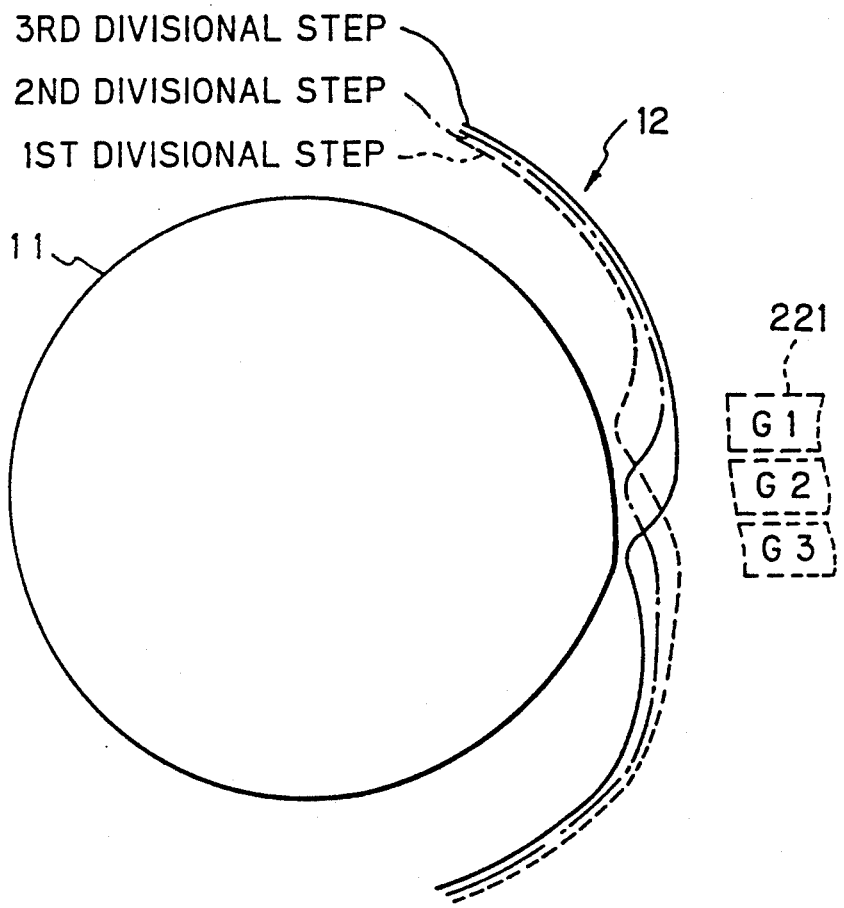
Fig. 4 PRIOR ART

A prior art method of divisional step dot printing is illustrated in FIGS. 3 and 4. In this method, all of the dot pins P1, P2, . . . P24 are divided into three groups, GROUP 1, GROUP 2, AND GROUP 3, each consisting of 8 successive dot pins. In FIG. 3, a driven dot is expressed by a block dot. In a printing operation, GROUP 1 consisting of P1, P2, . . . P8 is driven in the first divisional step during the first travel of the carriage 21 over the length of the platen 11, GROUP 2 consisting of P9, P10, . . . P16 is driven in the second divisional step during the second travel of the carriage 21 over the length of the platen 11, and GROUP 3 consisting of P17, P18, . . . P24 is driven in the third divisional step during the third travel of the carriage 21 over the length of the platen 11. In this method, one row of printing is constituted by three parts, upper, middle, and lower, and the printing of these three parts is carried out sequentially to print one row.

Figure 5:
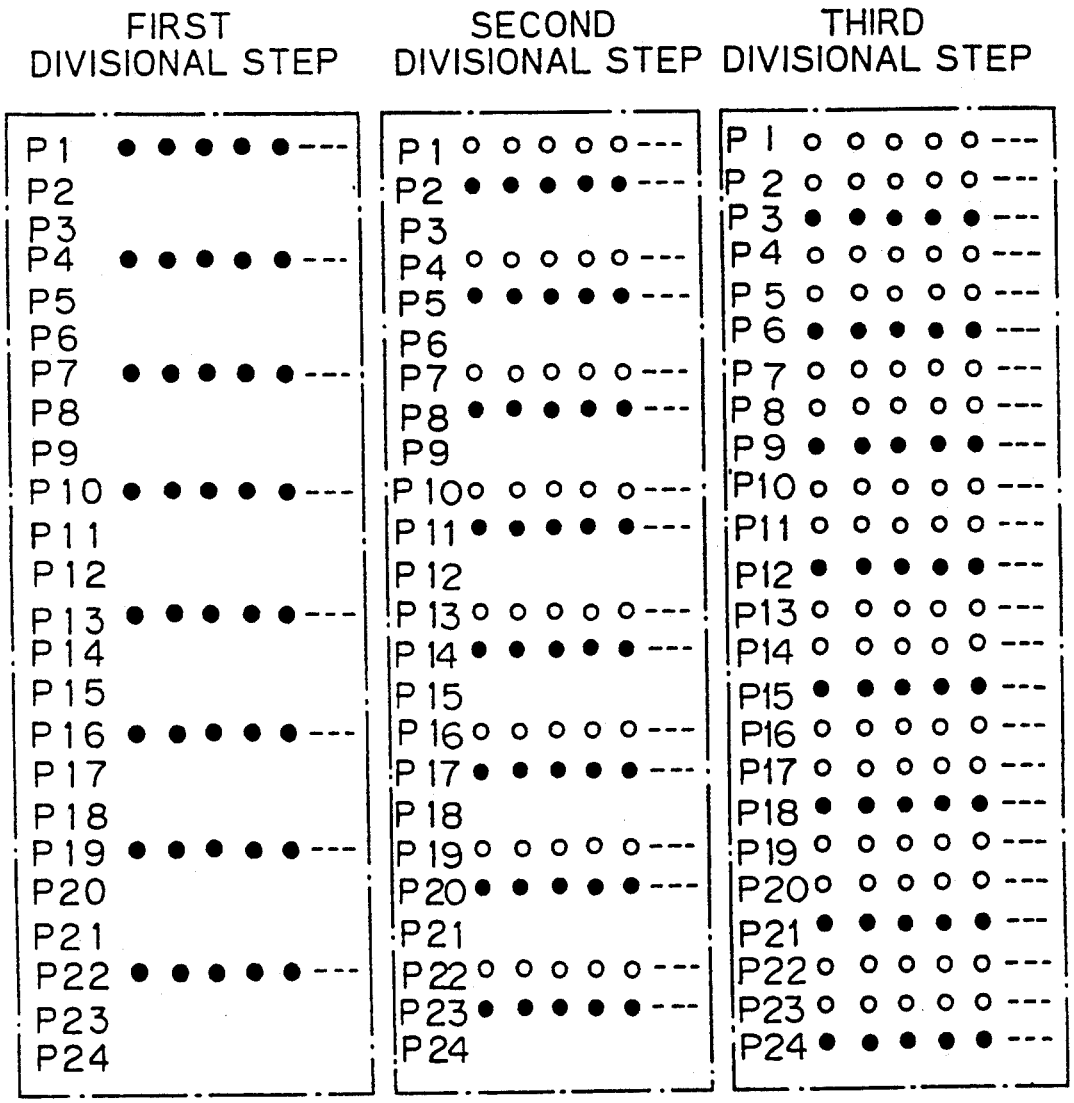
Fig. 5 PRIOR ART
FIGS. 5 and 6 illustrate another prior art method of divisional step dot printing.
Figure 6:
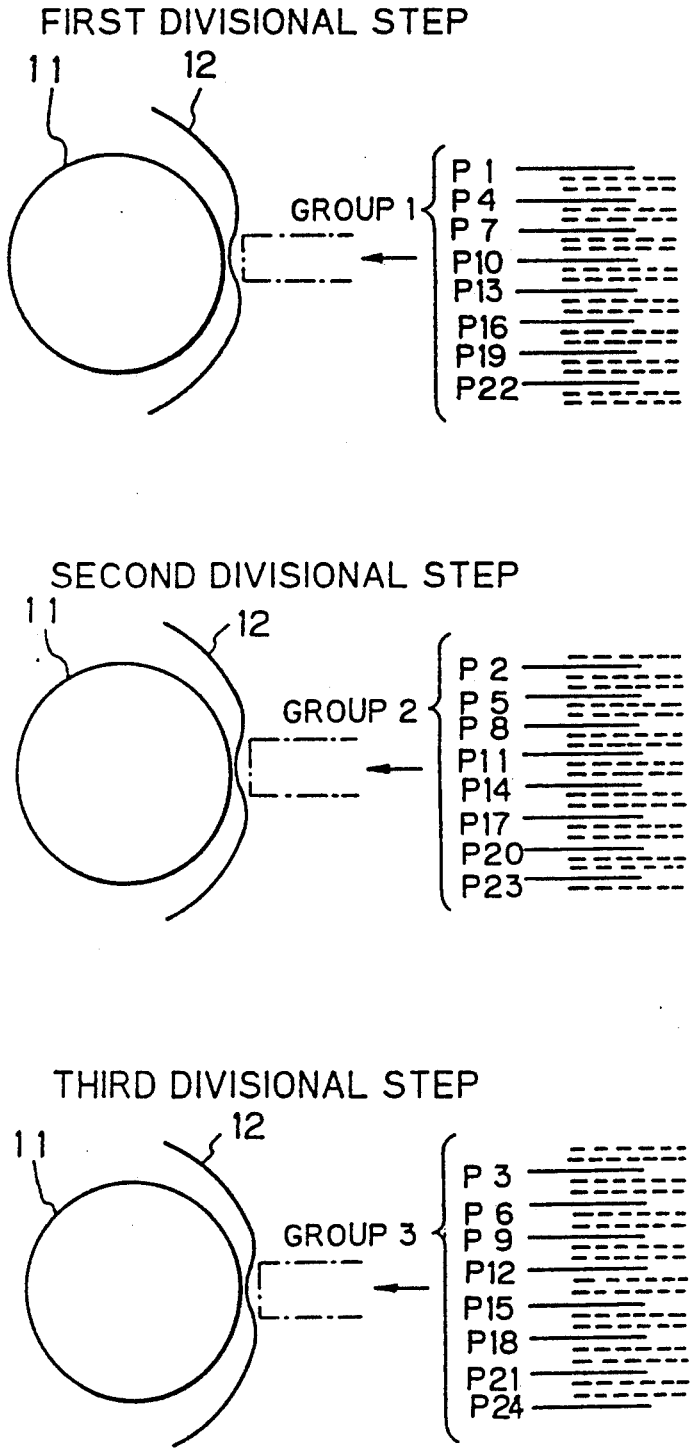
Fig. 6 PRIOR ART

Another prior art method of divisional step dot printing is illustrated in FIGS. 5 and 6. In this method, all of the dot pins P1, P2, . . . P24 are divided into three groups, GROUP 1, GROUP 2, and GROUP 3, each consisting of 8 dot pins at intervals of two dot pin positions. In the printing operation, GROUP 1 consisting of P1, P4, P7, P10, P13, P16, P19, and P22 is driven in the first divisional step during the first travel of the carriage 21 over the length of the platen 11, GROUP 2 consisting of P2, P5, P8, P11, P14, P17, P20, and P23 is driven in the second divisional step during the second travel of the carriage 21 over the length of the platen 11, and GROUP 3 consisting of P3, P6, P9, P12, P15, P18, P21, and P24 is driven in the third divisional step during the third travel of the carriage 21 over the length of the platen 11.

In this method, one row of printing is constituted by a plurality of row constituents, and the printing of this plurality of row constituents is carried out sequentially to print one row. Reference can be made to U.S. Pat. No. 4,743,127.

Figure 7:
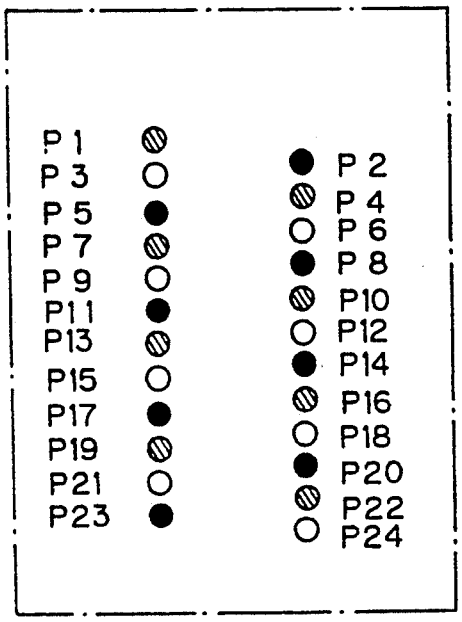
Fig. 7 PRIOR ART
FIG. 7 illustrates a modification of the method illustrated in FIG. 5.

Alternatively, it is possible to use the modified arrangement of dot pins shown in FIG. 7, in which the dot pins P1, P2, . . . P24 are arranged in a zigzag fashion.

In the method shown in FIGS. 3 and 4, however, a problem arises in that the paper 12 is deformed in a different way, as shogun by a broken line, a one dot chain line, and a solid line, in correspondence with the first, second, and third divisional steps, leading to an undesirable shifting of the paper 12 over the first, second, and third divisional steps, and accordingly, the colors printed by the first, second, and third divisional steps are overlapped or separated from each other.

Also, in the method shown in FIGS. 5, 6, and 7, a problem arises in that the space between simultaneously driven adjacent dot pins is relatively large, and therefore, the impact of dot pin onto the paper on the platen is made by a single dot pin, without considering the accumulated effect of the simultaneous impact of a plurality of adjacent dot pins as in the case of FIGS. 3 and 4, and accordingly, the density of colors printed by the first, second, and third divisional steps is usually low.

The principle of the operation of a divisional dot printing device according to an embodiment of the present invention will be described with reference to FIG. 8. The operation of the divisional dot printing device shown in FIG. 8 is applicable to the dot printer shown in FIGS. 1 and 2.

Figure 8:
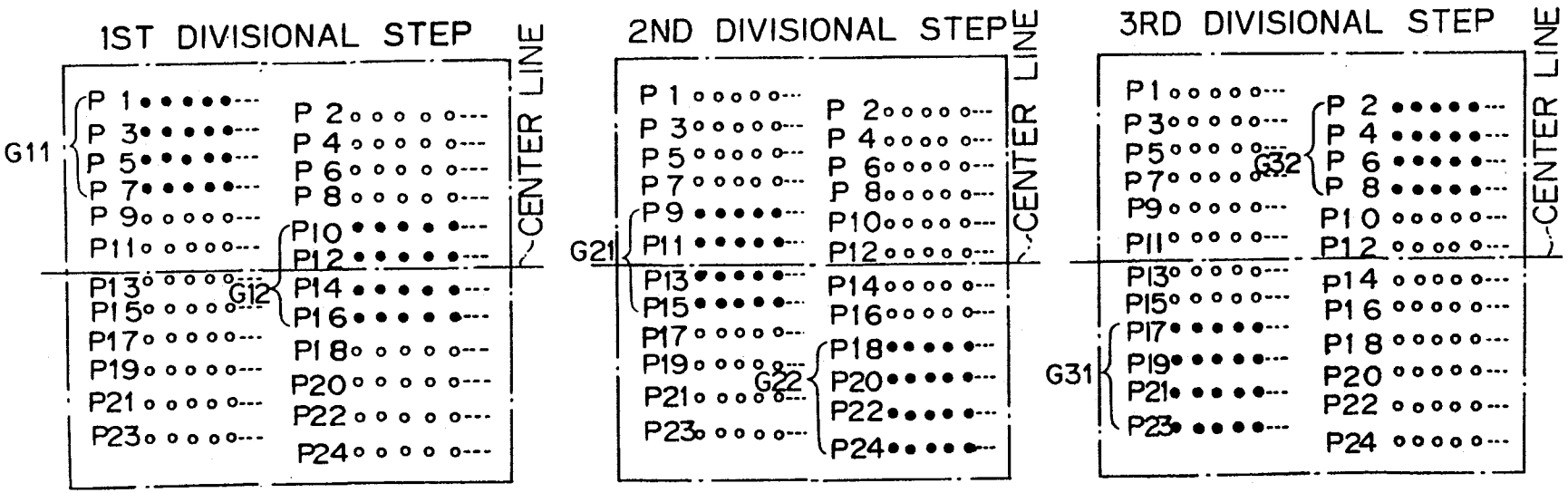
FIG. 8 illustrates the principle of the operation of a divisional step dot printing device according to an embodiment of the present invention.

As shown in FIG. 8, all of the dot pins P1, P2, . . . P24 are divided into six groups, i.e., G11, G21, G31, G32, G12, and G22, and the printing is carried out in a sequence of divisional steps, i.e., a first divisional step, a second divisional step, and a third divisional step. Each of the groups G11, G21, G31, G32, G12, and G22 is constituted by a sequence of successive dot pins, i.e., G11 by P1, P3, P5, and P7, G21 by P9, P11, P13, and P15, G31 by P17, P19, P21, and P23, G32 by P2, P4, P6, and P8, G12 by P10, P12, P14, and P16, and G22 by P18, P20, P22, and P24.

In the first divisional step, the groups G11 and G12 are driven, in the second divisional step the groups G21 and G22 are driven, and in the third divisional step the groups G31 and G32 are driven. In each of the first to third divisional steps, each of the combination of the driven groups of dot pins, i.e., G11 and G12 in the first divisional step, G21 and G22 in the second divisional step, and G31 and G32 in the third divisional step, substantially cover the center line of the platen 11. Namely, in the first divisional step, G12 directly covers the center line, in the second divisional step, G21 directly covers the center line, and in the third divisional step, G31 and G32 hold the center line therebetween.

As shown in FIG. 8, each of the groups G11, G21, G31, G32, G12, and G22 is constituted by a sequence of successive dot pins and the interval between adjacent dot pins in any of the groups is small, and accordingly, the force of the impact of the dot pins onto the paper to be printed is increased, and thus the density of the colors printed by the divisional step printing sequence is increased.

Also, as shown in FIG. 8, the printing operations on the paper in the first, the second, and the third divisional steps are located in neighbouring positions or at similar positions, and thus the undesirable shifting of the paper as in the prior art is prevented, and accordingly, a satisfactory result is obtained by the divisional step printing sequence.

Figure 9:
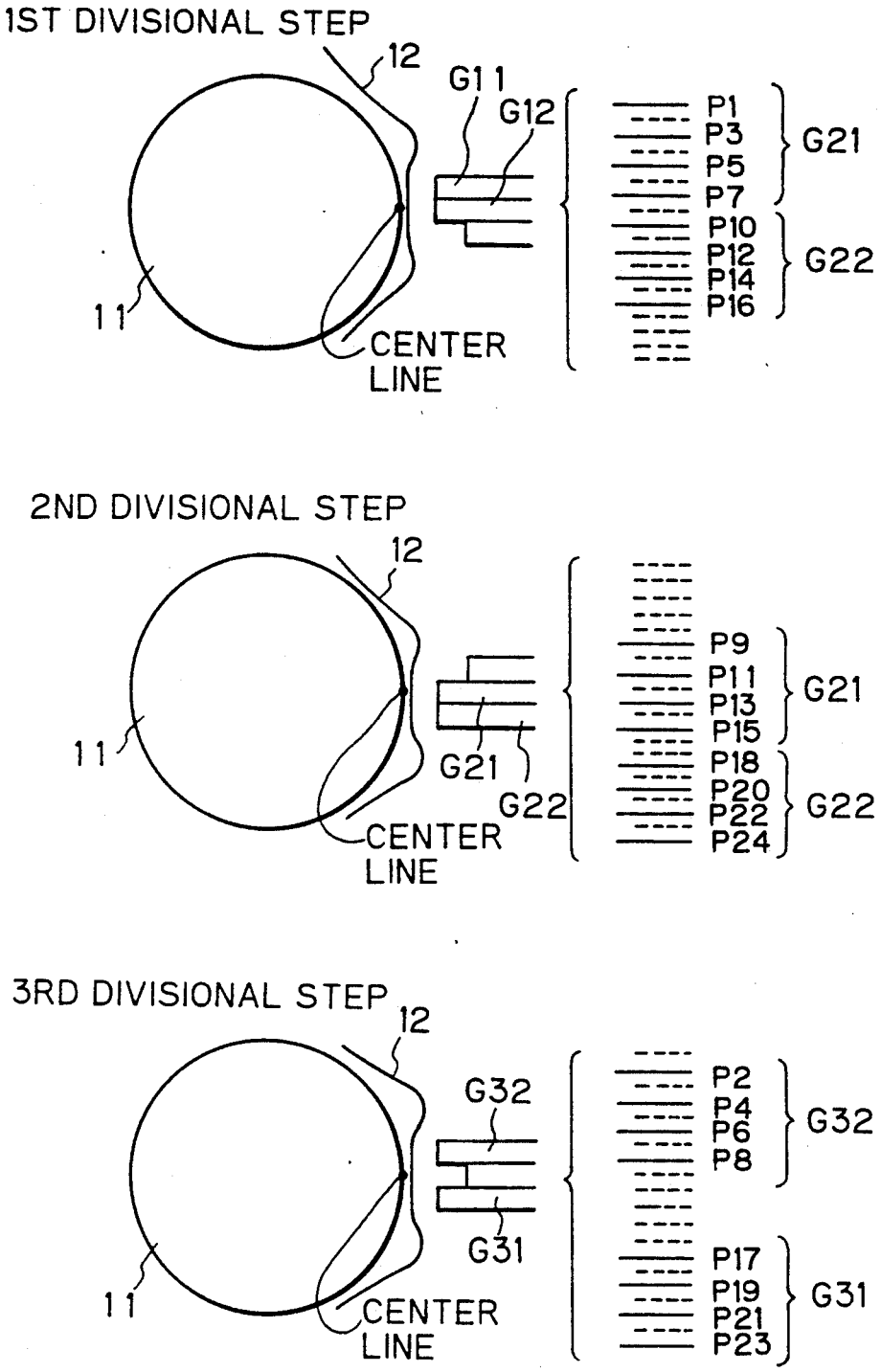
FIG. 9 illustrates the operation of a divisional step dot printing device according to an embodiment of the present invention.

The operation of a divisional step dot printing device according to an embodiment of the present invention is illustrated in FIG. 9 in connection with FIG. 8.

Here, the dot pins P1 to P24 are arranged in a zigzag fashion in two columns, as shown in FIG. 1. The odd number pins P1 to P23 are in the left column, and the even number pins P2 to P24 are in the right column.

As shown in FIG. 9, in the first divisional printing step, the groups G11 and G12 of dot pins strike the upper and middle parts of the paper 12 on the platen 11, in the second divisional printing step, the groups G21 and G22 of dot pins strike the middle and lower parts of the paper 12 on the platen 11, and in the third divisional printing step, the groups G32 and G31 of dot pins strike the upper and lower parts of the paper 12 on the platen 11. In each of the first, the second, and the third divisional printing steps the driven dot pins substantially cover the center line, and throughout the sequence of the first, second, and third divisional printing steps, the dot pins stroke at neighbouring positions or similar positions.

Figure 10:
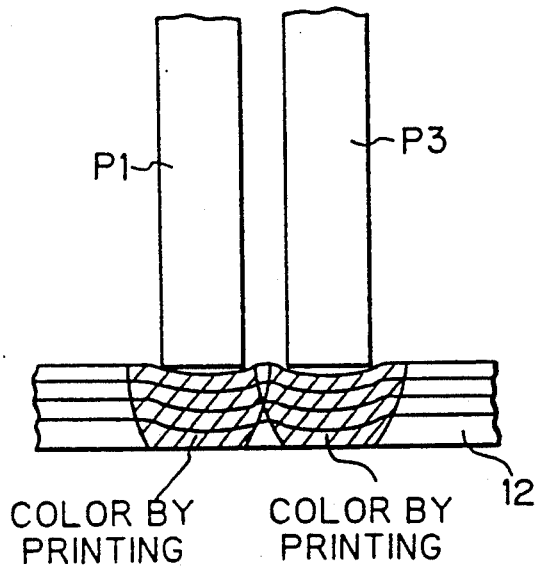
FIG. 10 illustrates the appearance of color printed on a print medium by the impact of dot pins.

In the operation of the device illustrated in FIG. 9, the interval between adjacent dot pins P1 and P3, which are driven simultaneously, is relatively small, the force of the impact of the dot pins onto the paper 12 is increased, and the density of the appearance of the color printed on the paper 12 is satisfactorily maintained, as illustrated in FIG. 10.

Figures 11, 11A:
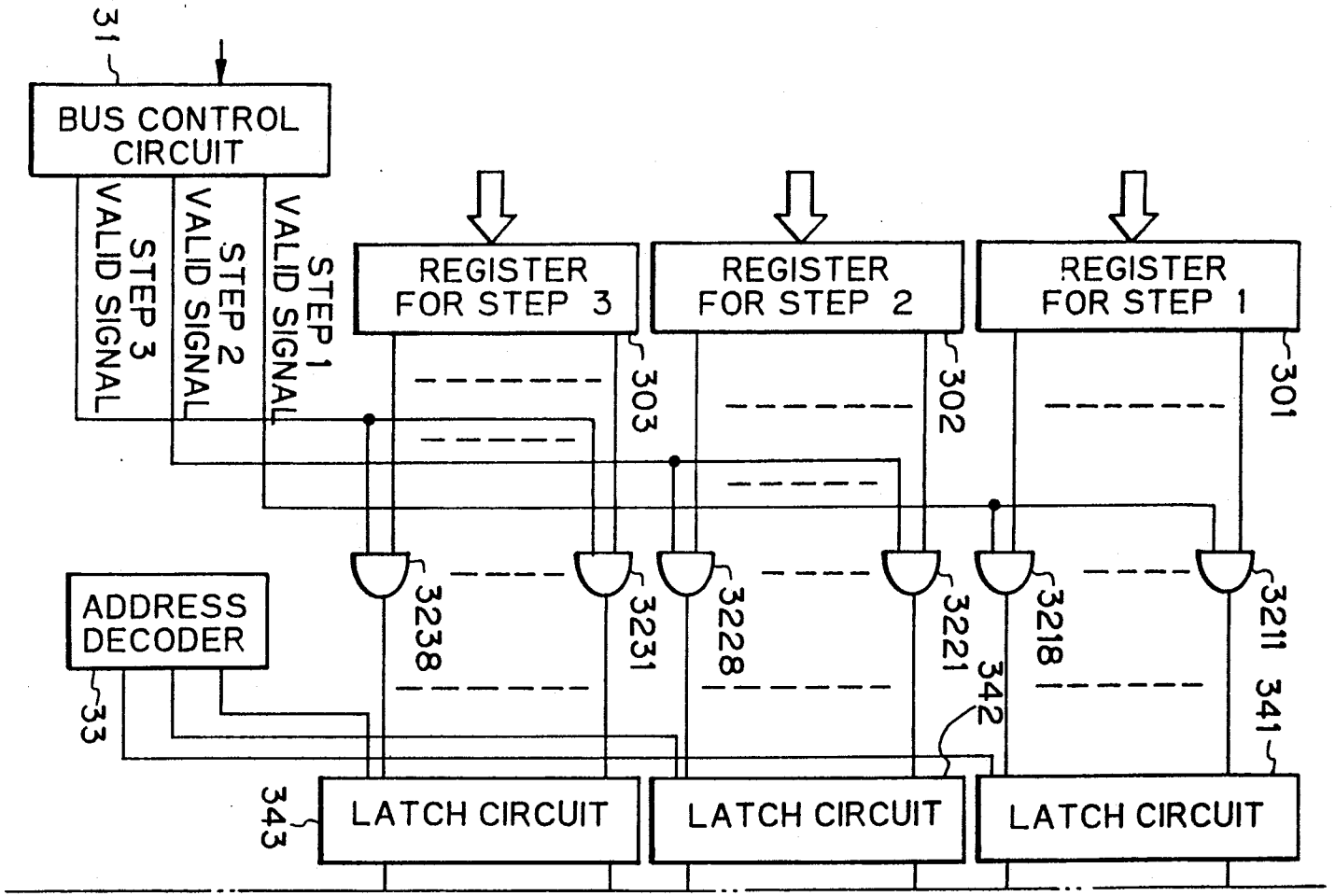
FIGS. 11, 11A and 11B are the block diagram of a circuit of a divisional step printing device according to an embodiment of the present invention.
Figure 11B:
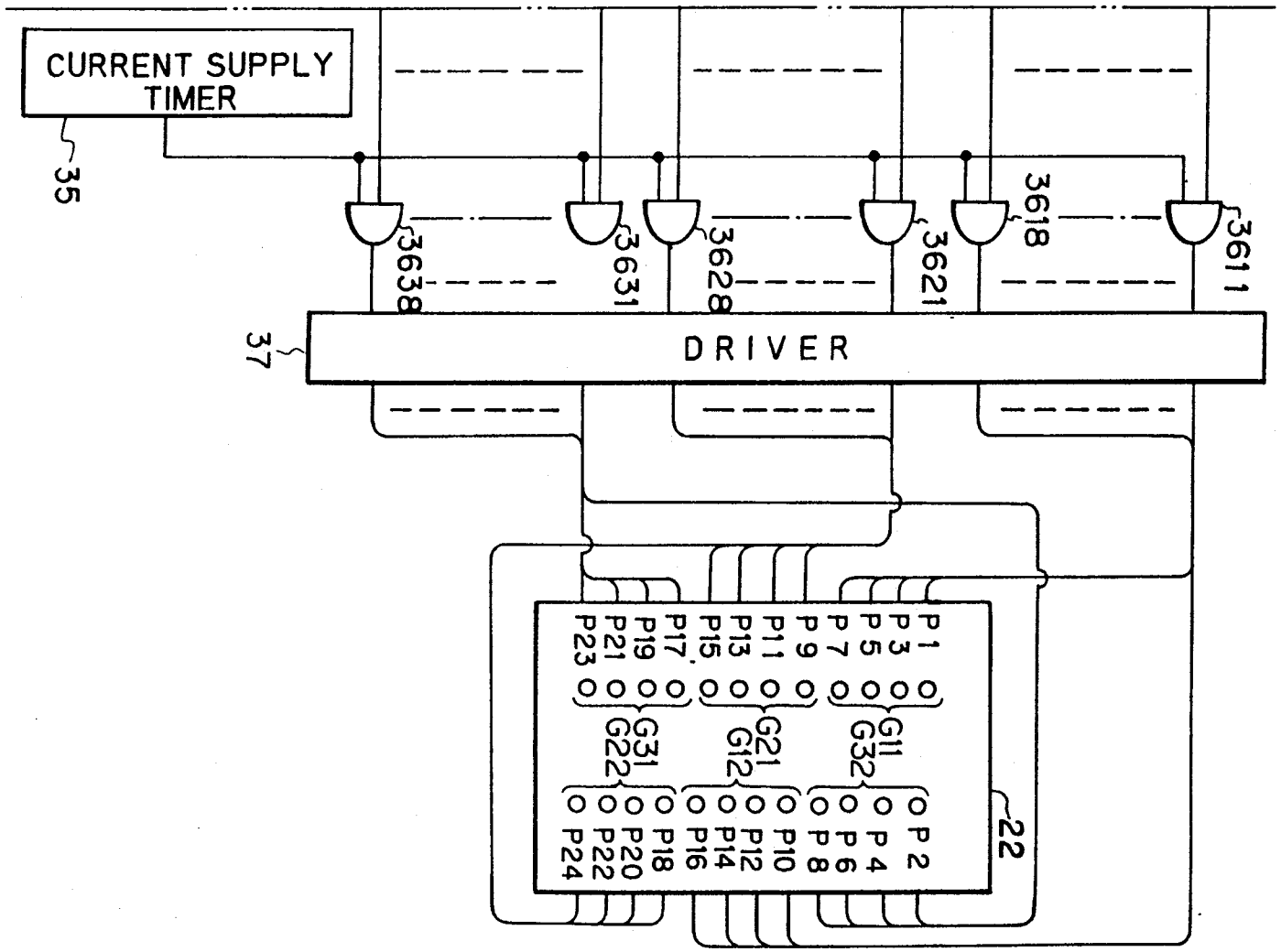

A block diagram of a circuit of a divisional step printing device according to an embodiment of the present invention is shown in FIG. 11. The device of FIG. 11 includes data registers 301, 302, and 303, a bus control circuit 31, AND gates 3211 to 3218, 3221 to 3228, and 3231 to 3238, an address decoder 33, latch circuits 341, 342, and 343, a current supply timer 35, AND gates 3611 to 3618, 3621 to 3628, and 3631 to 3638, a driver 37, and a printing head 22.

The first divisional step data registered in the data register 301 passes through AND gates 3211 to 3218, is latched by the latch circuit 341, passes through AND gates 3611 to 3618, and is then supplied to the driver 37 to drive the groups G11 and G12 of the dot pins.

The second divisional step data registered in the data register 302 passes through AND gates 3221 to 3228, is latched by the latch circuit 342, passes through AND gates 3621 to 3628, and is then supplied to the driver 37 to drive the groups G21 and G22 of the dot pins.

The third divisional step data registered in the data register 303 passes through AND gates 3231 to 3238, is latched by the latch circuit 343, passes through AND gates 3631 to 3638, and is then supplied to the driver 37 to drive the groups G31 and G32 of the dot pins.

In the case of a non-divisional-step printing, all of the potentials of the step 1 valid signal, step 2 valid signal, and step 3 valid signal delivered from the bus control circuit 31 are made HIGH. In the case of a divisional step printing, the potentials of the step 1 valid signal, step 2 valid signal, and step 3 valid signal delivered from the bus control circuit 31 are sequentially made HIGH. The step 1, step 2, and step 3 valid signals delivered from the bus control circuit 31 are supplied to input terminals of the AND gates 3211 to 3218, 3221 to 3228, and 3231 to 3238.

The current supply timer 35 supplies an energization pulse having a predetermined duration to input terminals of the AND gates 3611 to 3618, 3621 to 3628, and 3631 to 3638.

In the divisional step printing operation mode of the device of FIG. 11, in the first divisional step, the potential of the STEP 1 VALID SIGNAL from the bus control circuit 31 is made HIGH and the potentials of the STEP 2 and STEP 3 VALID SIGNALS are made LOW, the AND gates 3211 to 3218 are turned ON, and the groups G11 and G12 of dot pins are driven through the latch circuit 341, the AND gates 3611 to 3618, and the driver 37.

In the second divisional step, the potential of the STEP 2 VALID SIGNAL from the bus control circuit 31 is made HIGH and the potentials of the STEP 1 and STEP 3 VALID SIGNALs are made LOW, the AND gates 3221 to 3228 are turned ON, and the groups G21 and G22 of dot pins are driven through the latch circuit 342, the AND gates 3621 to 3628, and the driver 37.

In the third divisional step, the potential of the STEP 3 VALID SIGNAL from the bus control circuit 31 is made HIGH and the potentials of the STEP 1 and STEP 2 VALID SIGNALs are made LOW, the AND gates 3231 to 3238 are turned ON, and the groups G31 and G32 of dot pins are driven through the latch circuit 343, the AND gates 3631 to 3638, and the driver 37.

In the non-divisional-step printing operation mode of the device of FIG. 11, the potentials of all of the STEP 1, STEP 2, and STEP 3 VALID SIGNALs are made HIGH, all of the AND gates 3211 to 3218, 3221 to 3228, and 3231 to 3238 are turned ON, and all of the groups G11, G12, G21, G22, G31, and G32 of dot pins are driven through the latch circuits 341, 342, and 343, the AND gates 3611 to 3618, 3621 to 3628, and 3631 to 3638, and the driver 37.

Figure 12:
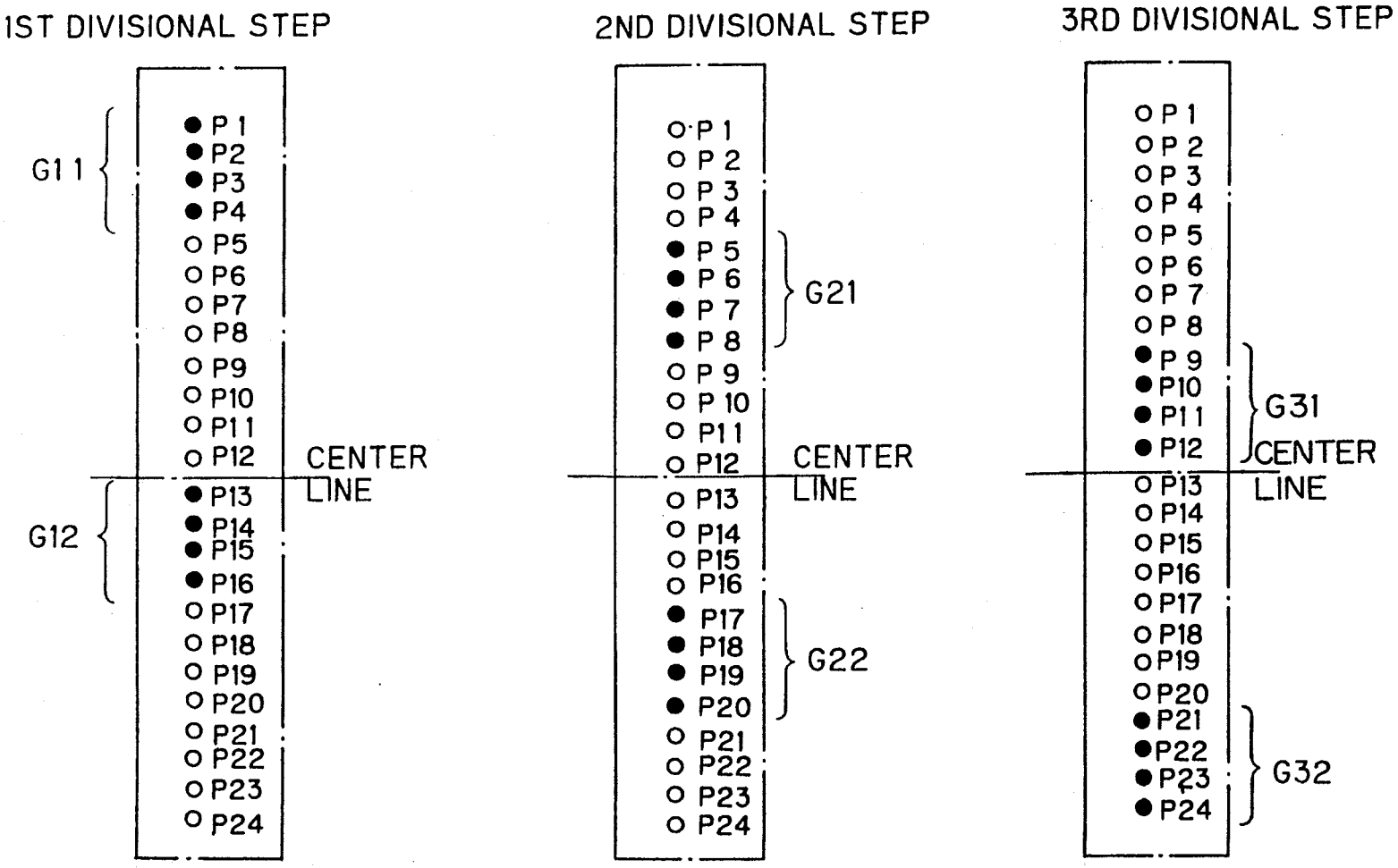
FIG. 12 illustrates an operation of a divisional step dot printing device according to another embodiment of the present invention.

The operation of a divisional step dot printing device according to another embodiment of the present invention is illustrated in FIG. 12. In the operation illustrated in FIG. 12, the dot pins P1 to P24 are arranged in a single column, and are divided into groups of the successive dot pins: G11, G21, G31, G12, G22, and G32.

In the operation illustrated in FIG. 12, in the first divisional step the groups G11 and G12 are driven, in the second divisional step the groups G21 and G22 are driven, and in the third divisional step the groups G31 and G32 are driven.

Instead of the operation illustrated in FIG. 8, it is possible to drive the groups G11 and G22 in the first divisional step, the groups G21 and G12 in the second divisional step, and the groups G31 and G32 in the third divisional step.

Instead of the operation illustrated in FIG. 8, it is also possible to adopt a number of the dot pins other than 24, and to adopt a number of divisional steps other than three.

I claim:

1. A divisional step dot printing device wherein divisional step dot printing comprises at least two types of divisional steps, said device comprising:

printing head means having a plurality of head pins divided into at least four groups, with each group having an equal number of head pins, said printing head means having a center line with an equal number of said head pins above and below said center line;

print medium means on which printing by said printing head means is carried out, said print medium means being placed on a platen;

carriage means carrying said printing head means, said carriage means transporting said printing head means along an axis which is adjacent an axis of the platen, wherein at least two of said groups of head pins are separated along a vertical line which is perpendicular to said center line;

head pin selection means for selecting predetermined ones of said head pins in each of said at least four groups to contact and thereby print on said print medium means during each divisional step, wherein two groups are selected for each divisional step, and in at least one first type of divisional step one of said selected groups is positioned such that a number of said head pins from said one of said selected groups are above said center line, and an equal number of head pins from said group are below said center line, and in at least one second type of divisional step, two of said groups are selected and positioned so that they are entirely on opposite sides of said center line, and equidistant therefrom, and wherein for each type of divisional step, said two of said selected groups are disposed on opposite sides of said vertical line perpendicular to said center line.

2. A divisional step dot printing device as recited in claim 1, wherein each of said at least four groups comprises a plurality of head pins arranged adjacent each other in a horizontal direction parallel to said center line, and a plurality of head pins arranged adjacent each other in a vertical direction along a line parallel to said vertical line.

3. A divisional step dot printing device as recited in claim 1, wherein each of said at least four groups of head pins comprises a plurality of head pins arranged adjacent each other in a vertical direction.

4. A divisional step dot printing device wherein divisional step dot printing comprises at least two types of divisional steps, said device comprising:

printing head means having a plurality of head pins divided into at least four groups, with each group having an equal number of head pins, said printing head means having a center line with an equal number of said head pins above and below said center line;

print medium means on which printing by said printing head means is carried out, said print medium means being placed on a platen;

carriage means carrying said printing head means, said carriage means transporting said printing head means along an axis which is adjacent an axis of the platen, wherein at least two of said groups of head pins are separated along a vertical line which is perpendicular to said center line;

head pin selection means for selecting predetermined ones of said head pins in each of said at least four groups to contact and thereby print on said print medium means during each divisional step, wherein two groups are selected for each divisional step, and in at least one first type of divisional step at least two of said groups are positioned so that they are entirely on opposite sides of said center line, and equidistant therefrom, and wherein for each type of divisional step, two of said selected groups are disposed on opposite sides of said vertical line perpendicular to said center line.

5. A divisional step dot printing device as recited in claim 4, wherein said head pin selection means further selects head pins for at least one second type of divisional step wherein one of said groups of head pins is positioned such that a number of said head pins from said one of said groups are above said center line, and an equal number of head pins from said group are below said center line.

6. A divisional step dot printing device wherein divisional step dot printing comprises at least two types of divisional steps, said device comprising:

printing head means having a plurality of head pins divided into at least four groups, with each group having an equal number of head pins, said printing head means having a center line with an equal number of head pins above and below said center line, wherein each of the at least four groups comprises a plurality of head pins arranged adjacent to each other in a vertical direction;

print medium means on which printing by said printing head means is carried out, said print medium means being placed on a platen;

carriage means carrying said printing head means, said carriage means transporting said printing head means along an axis parallel said print medium means;

head pin selection means for selecting predetermined ones of said head pins in each of said at least four groups to contact and thereby print on said print medium means during each divisional step, wherein in each divisional step at least two groups are selected for each divisional step, and in at least one first type of divisional step one of said groups is positioned above said center line, and a second of said groups is positioned below said center line, and in at least one second type of divisional step, at least two of said groups are positioned so that they are entirely on opposite sides of said center line, and equidistant therefrom, whereby in each divisional step an even number of head pins are selected above and below said center line.

7. A divisional step dot printing device wherein divisional step dot printing comprises at least two types of divisional steps, said device comprising:

printing head means having a plurality of head pins divided into at least four groups, with each group having an equal number of head pins, said printing head means having a center line with an equal number of head pins above and below said center line;

printer medium means on which printing by said printing head means is carried out, said print medium means being placed on a platen;

carriage means carrying said printing head means, said carriage means transporting said printing head means along an axis parallel said print medium means;

head pin selection means for selecting predetermined ones of said head pins in each of said at least four groups to contact and thereby print on said print medium means during each divisional step wherein in each divisional steps two groups are selected for each divisional step, and in at least one first type of divisional step one of said groups is positioned above said center line, and a second of said groups is positioned below said center line, and in at least one second type of divisional step, two of said groups are positioned so that they are entirely on opposite sides of said center line, and equidistant therefrom, whereby in each divisional step an even number of head pins are selected above and below said center line.

* * * * *